US008986040B2

(12) United States Patent
Garofalo et al.

(10) Patent No.: US 8,986,040 B2
(45) Date of Patent: Mar. 24, 2015

(54) CHILD SAFETY PLUG LOCK

(71) Applicant: NUK USA LLC, Tarrytown, NY (US)

(72) Inventors: James Garofalo, Reedsburg, WI (US); Brian Vodvarka, Reedsburg, WI (US)

(73) Assignee: NUK USA LLC, Tarrytown, NY (US)

( * ) Notice: Subject to any disclaimer, the term of this patent is extended or adjusted under 35 U.S.C. 154(b) by 51 days.

(21) Appl. No.: 13/869,150

(22) Filed: Apr. 24, 2013

(65) Prior Publication Data

US 2014/0322959 A1 Oct. 30, 2014

(51) Int. Cl.
*H01R 13/639* (2006.01)

(52) U.S. Cl.
CPC ..... *H01R 13/6395* (2013.01)
USPC ..... 439/373

(58) Field of Classification Search
USPC ..... 439/373, 369, 137
See application file for complete search history.

(56) References Cited

U.S. PATENT DOCUMENTS

| | | | | | |
|---|---|---|---|---|---|
| 2,199,560 | A | | 5/1940 | Faller | |
| 2,484,558 | A | | 10/1949 | Eisner | |
| 2,659,059 | A | * | 11/1953 | Johnson | 439/373 |
| 3,161,450 | A | | 12/1964 | Goodenough | |
| 3,775,729 | A | | 11/1973 | Casper | |
| 3,990,758 | A | | 11/1976 | Petterson | |
| 4,045,108 | A | * | 8/1977 | Olsen | 439/368 |
| 4,111,509 | A | | 9/1978 | Novak et al. | |
| 4,618,200 | A | * | 10/1986 | Roberts et al. | 439/367 |
| 4,743,206 | A | | 5/1988 | Imhoff | |
| 4,840,577 | A | * | 6/1989 | Prouty | 439/373 |
| 5,194,013 | A | | 3/1993 | Propp | |
| 5,480,318 | A | | 1/1996 | Garrison et al. | |
| 5,599,196 | A | | 2/1997 | Powell | |
| 5,655,924 | A | | 8/1997 | Cross | |
| 6,071,142 | A | | 6/2000 | Blackman | |
| 6,309,239 | B1 | * | 10/2001 | Johnston | 439/373 |
| 6,370,037 | B1 | * | 4/2002 | Schoenfish | 361/807 |
| 6,491,539 | B1 | | 12/2002 | Johnston | |
| 6,805,580 | B2 | * | 10/2004 | Piedmont | 439/516 |
| 2007/0111586 | A1 | * | 5/2007 | Wilder | 439/373 |
| 2011/0237114 | A1 | * | 9/2011 | Beene et al. | 439/373 |

* cited by examiner

*Primary Examiner* — Alexander Gilman
(74) *Attorney, Agent, or Firm* — Husch Blackwell LLP

(57) ABSTRACT

A child safety plug lock for releasably securing a plug within a power outlet. The plug lock comprises a body portion including a through-hole and left and right sides. The plug lock also includes left and right arm portions which extend from the left and right sides, respectively, of the body portion. Each arm portion includes an inwardly facing flange. The plug lock is designed to be secured to an outlet via the through-hole in the body portion. The flanges are sized and positioned to engage and retain a plug in the power outlet when the plug lock is attached to the power outlet via the through-hole. The left and right arm portions are flexible, and are sized and positioned such that pressure applied to an arm portion causes that arm portion to flex laterally away from the plug.

6 Claims, 3 Drawing Sheets

CHILD SAFETY PLUG LOCK

CROSS-REFERENCE TO RELATED APPLICATIONS

None.

BACKGROUND OF THE INVENTION

Conventional electrical plugs can be easily inserted into and removed from outlet receptacle sockets so as to provide quick and convenient connection with a source of electrical power. However, the ease of removal can be disadvantageous, especially in instances where a small child may be apt to remove the plug from the socket or in cases where the plug supplies power to a vital appliance or device. Not only will the removal of the plug terminate the supply of power to the appliance or device to which it is connected, but it can also present safety concerns, as the electrical socket will be exposed and accessible. Equally as dangerous are cases where the plug is only partially removed thereby exposing the prongs carrying electrical current.

However, permanently or fixedly attaching a plug to an outlet has its own dangers. If an issue or emergency involving an electrical appliance or device occurs, often the quickest way to remedy the issue is to unplug the appliance or device from the outlet to which it is connected, thereby terminating the supply of power. However, if the plug is fixedly secured to the outlet, it can be very difficult to unplug it in a quick manner.

In other instances, where small children are not present or where the plug is not connected to a vital appliance or device, it is preferable that the plug be adapted for easy insertion and removal from outlet receptacle sockets. It is therefore desirable to provide a plug that may be semi-permanently connected to an electrical outlet, yet may be removed quickly with a requisite amount of force in case of an emergency.

SUMMARY OF THE INVENTION

The present invention relates to embodiments of a child safety plug lock for releasably securing a plug within a power outlet. In one embodiment, the plug lock comprises a body portion including a through-hole and left and right sides. The plug lock also includes left and right arm portions which extend from the left and right sides, respectively, of the body portion. Each said arm portion includes an inwardly facing flange. The plug lock is designed to be secured to an outlet via the through-hole in the body portion. The flanges are sized and positioned to engage and retain a plug in the power outlet when the plug lock is attached to the power outlet via the through-hole. The left and right arm portions are flexible, and are sized and positioned such that pressure applied to an arm portion causes that arm portion to flex laterally away from the plug. In so doing, the flange of the flexed arm is disengaged from retaining the plug in the power outlet.

In one embodiment, the arm portions extend perpendicularly outward from the body portion and outlet, such that lateral outward pressure on an arm portion causes the arm and the associated flange to flex laterally away from the plug. More specifically, in this embodiment, each arm portion may include a first section which extends in the y direction from the body portion to a distal end thereof, and a second section which extends perpendicularly outward from the distal end of the first section in the z direction. In this embodiment, the flange is positioned on the second portion near the distal end of the first portion.

However, in another embodiment, the arm portions at least partially extend laterally away from the plug, such that pressure which depresses the laterally extending section of an arm portion causes the arm portion to flex, which moves the flange laterally away from the plug. In this embodiment, each arm portion preferably includes three sections: a first section which extends in the y direction from the body portion to a distal end of the first section, a second section which extends perpendicularly outward from the distal end of the first section in the z direction to a distal end of the second section, and a third section which extends from the distal end of the second section laterally outward in the x direction. In this embodiment, the flange is positioned on the second portion near the distal end of the first portion.

DETAILED DESCRIPTION OF THE INVENTION

Figure 1:
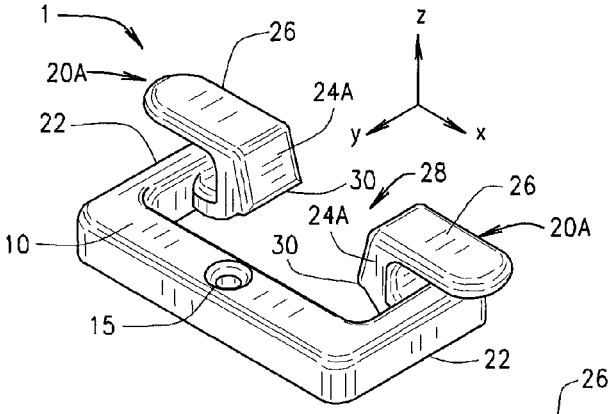
FIG. 1 is a perspective view of a child-resistant plug lock constructed in accordance with the teachings of the present invention.
Figure 2:
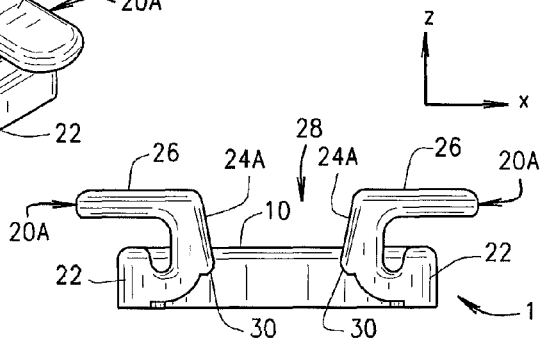
FIG. 2 is a top plan view of the child-resistant plug lock of FIG. 1.
Figure 3:
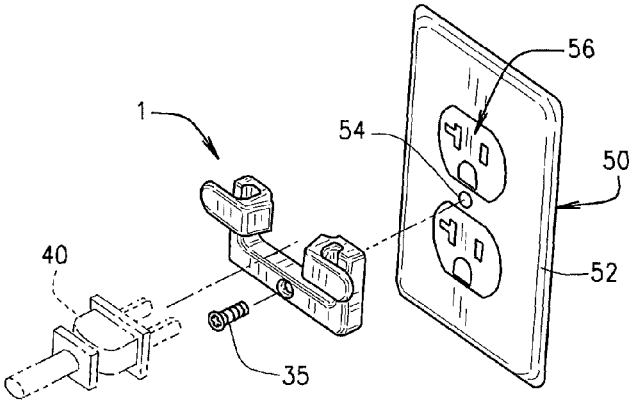
FIG. 3 is a perspective view of the child-resistant plug lock of FIG. 1 aligned for connection with the upper socket of an electrical outlet.
Figure 4:
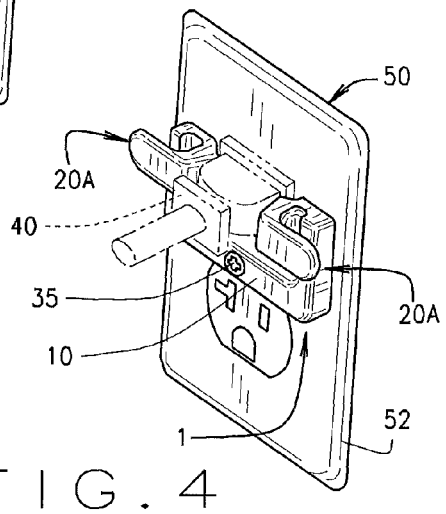
FIG. 4 is a perspective view of the child-resistant plug lock of FIG. 1 as inserted into the upper socket of an electrical outlet.

Referring to the drawings particularly by reference numbers wherein like numerals refer to like parts, FIGS. 1-6 illustrate one embodiment of a child safety plug lock 1. The plug lock 1 includes a body portion 10 which extends longitudinally along the x-axis, as shown in FIG. 1. A through-hole 15 is positioned along the body portion 10. As can be seen in FIGS. 3 and 4, through-hole 15 is positioned to align with a central screw-receiving hole in a standard faceplate 52 of an electrical outlet 50. Preferably, a screw 35 may be used to secure the plug lock 1 to the outlet 50, as this is the standard mechanism for securing the faceplate 52 to the outlet 50 in most standard outlets. However, other structures could be used for this purpose, as would be recognized by one of ordinary skill in the art.

Figure 6:
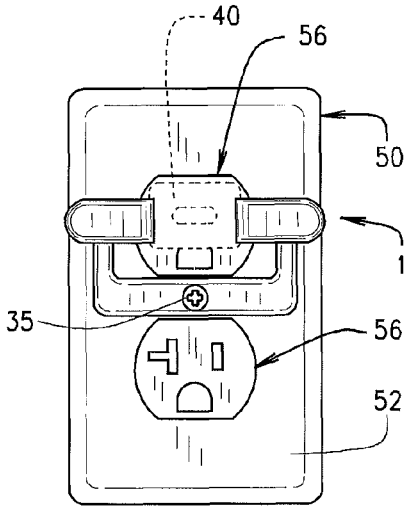
FIG. 6 is a front elevation view of the child-resistant plug lock of FIG. 1 as inserted into the upper socket of an electrical outlet.

Thus, as can best be seen in FIG. 6, when affixed to an electrical outlet 50, the body portion 10 is typically positioned between the electrical sockets 56. It is noted that some outlets 50 include faceplates 52 with two screw-holes 54 positioned at the top and bottom of the faceplate 52, rather than a single screw-hole 54 positioned at the middle of the faceplate 52. With such a faceplate 52 and outlet 50, the body portion 10 would be positions above or below the electrical sockets 56. For ease of reference, plug lock 1 will be described herein as installed on a standard outlet 50 with a faceplate 52 having a central screw-hole 54, and as oriented to interact with a plug 40 when plugged into an upper electrical socket 56.

As shown in FIGS. 1-6, an embodiment of the plug lock 1 includes left and right arm portions 20A which extend from the left and right ends, respectively, of body portion 10. Each arm portion 20A includes three sections: a first section 22, a second section 24A and a third section 26. As best seen in FIGS. 1 and 6, first section 22 preferably extends perpendicularly to the longitudinal length of the body portion 10 in the y-axis, i.e. upwardly toward the upper socket 56 as installed. The first section 22 thus extends to its distal end from the body portion 10, such that the distal end is approximately even with upper socket 56. As best seen in FIGS. 2 and 5A, second section 24A extends perpendicularly outward in the z direction from the distal end of the first section 22. As installed, second section 24A extends generally outwardly from outlet 50, approximately even with the upper socket 56, to the distal end of the second section 24A. Third section 26 then extends from the distal end of the second section 24A laterally in the x direction. As installed, the third section 26 extends laterally away from the upper socket 56 at a height above but substantially parallel with the faceplate 52. A flange 30 is preferably positioned on the second section 24A near where the second section 24A extends from the distal end of the first section 22.

Figure 5A:
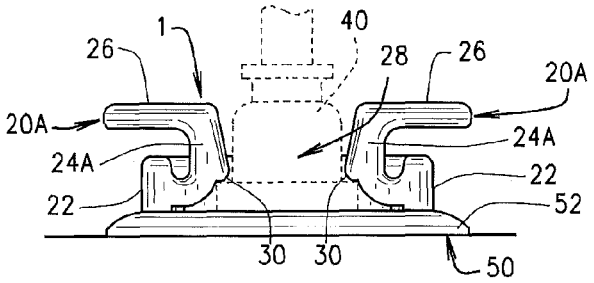
FIG. 5A is a top plan view of the child-resistant plug lock of FIG. 1 as inserted into the upper socket of an electrical outlet in a resting position.

As can be seen in FIGS. 2 and 5A, the left and right arm portions 20A oppose and mirror one another, and define a space 28 therebetween for receiving an electrical plug 40. Preferably, as best seen in FIG. 5A, the inward face of each second section 24A, which faces the opposing arm portion 20A, tapers as second section 24A extends outward along the z-axis. Thus, the space 28 for receiving electrical plug 40, which is defined by arm portions 20A, is initially wider but becomes narrower approaching the outlet 50, so as to help guide electric plug 40 for engagement with a socket 56. Additionally, at least the second sections 24A of the left and right arm portions 20A are flexible so as to be capable of flexing in a direction generally away from socket 56, and then rebound back to substantially its original position.

Figure 5B:
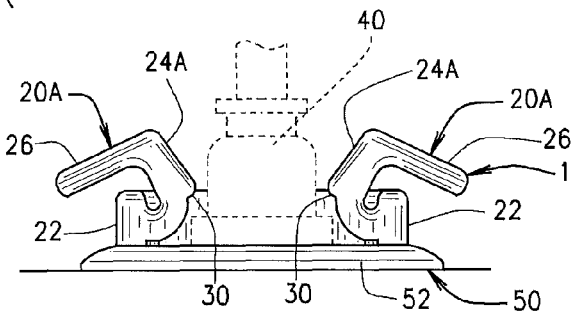
FIG. 5B is a top plan view of the child-resistant plug lock of FIG. 1 as inserted into the upper socket of an electrical outlet, with the arm portions depressed in position to allow the plug to be withdrawn from the socket.

In operation, once the plug lock 1 has been installed on an outlet 50, a user may insert an electrical device's plug into the socket 56 with which the plug lock 1 is associated. As can be seen in FIGS. 2, 5A and 5B, flanges 30 on the second sections 24A of arm portions 20A initially extend into the space 28 such that the space 28 becomes too narrow for a standard plug 40 to fit through. Thus, when a plug 40 is pushed into the space 28, the plug pushes laterally on the inside of second arm sections 24A and/or flanges 30, so as to cause second arm sections 24A to flex laterally away from socket 56. By flexing in this way, the movement of second arm sections 24A causes the distance between the two flanges 30 to increase. Thus, plug 40 is able to pass therebetween for engagement with socket 56. As can be seen in FIGS. 5A and 5B, once the widest part of plug 40 passes between flanges 30, the arm portions 20A rebound to substantially their original positions. The flanges 30 thereby extend over the top of at least a part of plug 40 to make removing plug 40 from socket 56 much more difficult.

When removing the plug 40 from socket 56 is desired, a user may depress (i.e., apply pressure in the z direction) the third arm sections 26. As above, the second arm sections 24A are flexible, and the pressure on the third arm sections 26 again causes the second arm sections 24A to flex laterally away from socket 56. As shown in FIG. 5B, by flexing in this way, the movement of second arm sections 24A again causes the distance between the two flanges 30 to increase such that plug 40 is able to be extracted back therethrough. Releasing the third arm sections 26 again allows the second arm sections 24A to rebound back to substantially their original positions. It is also recognized that the plug 40 may be inserted into outlet 50 by first depressing the third arm sections 26 so as to provide sufficient space for the plug 40 to clear the flanges 30 during the insertion process.

Figure 7:
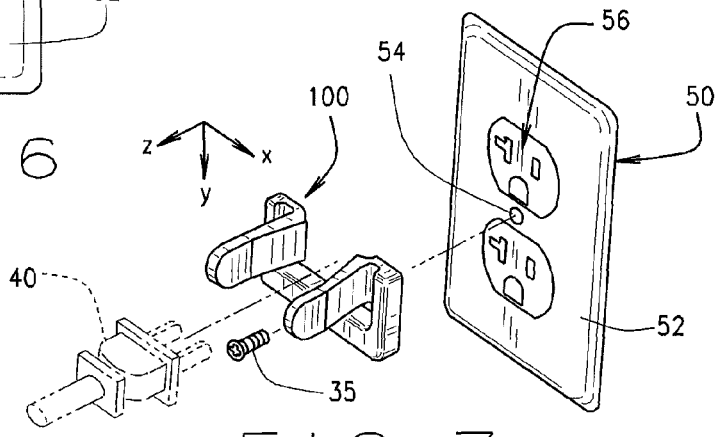
FIG. 7 is a perspective view of an alternative embodiment of a child-resistant plug lock aligned for connection with the upper socket of an electrical outlet.
Figure 8A:
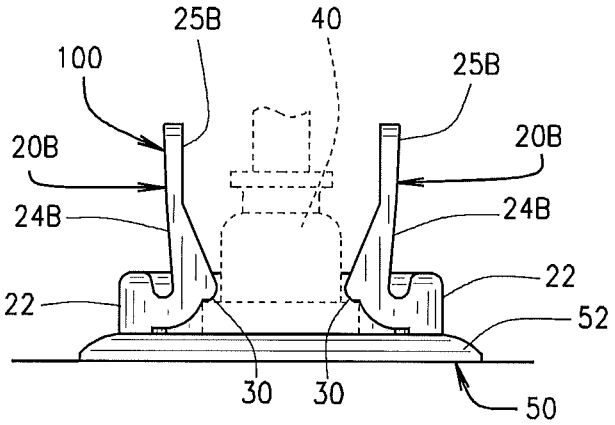
FIG. 8A is a top plan view of the alternate embodiment of a child-resistant plug lock of FIG. 7 as inserted into the upper socket of an electrical outlet in a resting position.
Figure 8B:
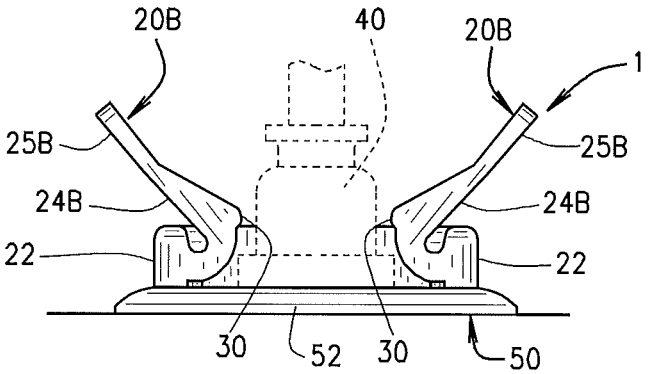
FIG. 8B is a top plan view of the alternate embodiment of a child-resistant plug lock of FIG. 7 as inserted into the upper socket of an electrical outlet, with the arm portions pressed laterally and in position to allow the plug to be withdrawn from the socket While the disclosure is susceptible to various modifications and alternative forms, specific embodiments thereof are shown by way of example in the drawing and will herein be described in detail. It should be understood, however, that the drawings and detailed description presented herein are not intended to limit the disclosure to the particular embodiment disclosed, but on the contrary, the intention is to cover all modifications, equivalents, and alternatives falling within the spirit and scope of the present disclosure as defined by the appended claims.

An alternative embodiment of a plug lock 100 is shown in FIGS. 7, 8A, and 8B. This embodiment is substantially the same as plug lock 1 discussed above, except that instead of having three arm sections 22, 24A and 26, plug lock 100 includes only two such aim sections. First aim section 22 of arm portions 20B of plug lock 100 is substantially the same as with plug lock 1. However, second arm section 24B of plug lock 100 replaces second and third arm sections 24A, 26 of plug lock 1. In plug lock 100, second arm section 24B extends perpendicularly outward in the z direction from the distal end of the first section 22. A flange 30 is positioned on second arm section 24B in substantially the same location as on second arm section 24A in plug lock 1, and at least a part of the internal face of second arm section 24B tapers similarly to that shown in second arm section 24A of plug lock 1.

However, second arm section 24B preferably extends farther than does second arm section 24A, such that an end tab 25B is formed at the distal end of each second arm section 24B. In operation, a plug 40 may be inserted into socket 56 in essentially the same way as described above. The plug 40 pushes on second arm sections 24B and/or flanges 30, causing second arm sections 24B to flex laterally away from socket 56 so as to allow the plug 40 to pass therebetween. As can be seen in FIG. 8A, once the widest part of plug 40 passes between flanges 30, the arm portions 20B rebound to substantially their original positions. The flanges 30 thereby extend over the top of at least a part of plug 40 to make removing plug 40 from socket 56 much more difficult.

When removing the plug 40 from socket 56 is desired, a user may apply lateral pressure (i.e., apply pressure in the x direction) on end tabs 25B of second arm sections 24B. As above, the second arm sections 24B are flexible, and the pressure on the end tabs 25B again causes the second arm sections 24B to flex laterally away from socket 56. As shown in FIG. 8B, by flexing in this way, the movement of second arm sections 24B again causes the distance between the two flanges 30 to increase such that plug 40 is able to be extracted back therethrough. Releasing the end tabs 25B again allows the second arm sections 24B to rebound back to substantially their original positions.

Alternatively, it is recognized that instead of or in additional to flexible arm portions 20A, 20B, a plug lock may include a hinge or living hinge or the like. Regardless, the arm portions 20A, 20B are preferably biased toward a position in which a plug 40 cannot fit between flanges 30.

Thus, there has been shown and described an embodiment of a novel child-resistant plug lock. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present invention will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A child safety plug lock for releasably securing a plug within a power outlet, the plug lock comprising:

a body portion including a through-hole and left and right sides, said through-hole being positioned and located for aligning with a hole in the power outlet for connecting the plug lock thereto;

left and right arm portions extending from the left and right sides, of the body portion respectively, each said arm portion including an inwardly facing flange;

wherein said flanges are sized and positioned to engage and retain the plug in the power outlet when said plug lock is attached to the power outlet via the through-hole and the plug is inserted into the power outlet; and wherein the left and right arm portions are flexible, and are sized and positioned such that pressure applied to an arm portion causes that arm portion to flex laterally away from the plug, which disengages the flange of the flexed arm from retaining the plug in the power outlet.

2. The child safety plug lock of claim 1 wherein the arm portions at least partially extend laterally away from the plug, such that pressure which depresses the laterally extending section of an arm portion causes the arm portion to flex, which moves the flange laterally away from the plug.

3. A child safety plug lock for releasably securing a plug within a power outlet, the plug lock comprising:

a body portion including a through-hole and left and right sides;

left and right arm portions extending from the left and right sides of the body portion respectively, each said arm portion extending perpendicularly outward from said body portion and the power outlet and each including an inwardly facing flange;

wherein said flanges are sized and positioned to engage and retain the plug in the power outlet when said plug lock is attached to the power outlet via the through-hole and the plug is inserted into the power outlet; and wherein the left and right arm portions are flexible, and are sized and positioned such that lateral outward pressure applied to an arm portion causes that arm portion and the associated flange to flex laterally away from the plug, which disengages the flange of the flexed arm from retaining the plug in the power outlet.

4. The child safety plug lock of claim 1 wherein each arm portion includes a first section which extends perpendicularly to the longitudinal length of the body portion to a distal end of the first section, and a second section which extends perpendicularly outward from the distal end of the first section to a distal end of the second section, and a third section which extends from the distal end of the second section laterally outward away from the plug, and wherein the flange is positioned on the second section near the distal end of the first portion.

5. The child safety plug lock of claim 3 wherein each arm portion includes a first section which extends perpendicularly to the longitudinal length of the body portion to a distal end thereof, and a second section which extends perpendicularly outward from the distal end of the first section, and wherein the flange is positioned on the second section near the distal end of the first section.

6. A child safety plug lock for releasably securing a plug within a power outlet, the plug lock comprising:

a body portion including a through-hole and left and right sides;

left and right arm portions extending from the left and right sides of the body portion respectively each said arm portion including a first portion which extends perpendicularly to the longitudinal length of the body portion to a distal end of the first portion, a second portion which extends perpendicularly outwardly from the distal end of the first portion to the distal end of the second portion, and a third portion which extends from the distal end of the second portion laterally outward away from the plug, and each second portion including an inwardly facing flange located near the distal end of said first portion;

wherein said flanges are sized and positioned to engage and retain the plug in the power outlet when said plug lock is attached to the power outlet via the through-hole and the plug is inserted into the power outlet; and wherein the left and right arm portions are flexible, and are sized and positioned such that pressure applied to an arm portion causes that arm portion to flex laterally away from the plug, which disengages the flange of the flexed arm from retaining the plug in the power outlet.

* * * * *

UNITED STATES PATENT AND TRADEMARK OFFICE

CERTIFICATE OF CORRECTION

PATENT NO. : 8,986,040 B2
APPLICATION NO. : 13/869150
DATED : March 24, 2015
INVENTOR(S) : James Garofalo It is certified that error appears in the above-identified patent and that said Letters Patent is hereby corrected as shown below:

In the Specification

In Col. 4 line 30 delete both references to “aim” and replace with -- arm --

Signed and Sealed this
Seventh Day of July, 2015

Michelle K. Lee

Michelle K. Lee
*Director of the United States Patent and Trademark Office*